US008322720B2

(12) United States Patent
DeGruchy

(10) Patent No.: US 8,322,720 B2
(45) Date of Patent: Dec. 4, 2012

(54) SHEET BUFFERING SYSTEM

(75) Inventor: Paul J. DeGruchy, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 113 days.

(21) Appl. No.: 12/823,185

(22) Filed: Jun. 25, 2010

(65) Prior Publication Data

US 2010/0258999 A1 Oct. 14, 2010

Related U.S. Application Data

(62) Division of application No. 11/528,770, filed on Sep. 27, 2006, now Pat. No. 7,766,327.

(51) Int. Cl.
*B65H 5/02* (2006.01)
*B65H 5/04* (2006.01)

(52) U.S. Cl. ..... 271/273; 271/3.01; 271/3.03

(58) Field of Classification Search ..... 271/3.01, 271/3.03, 3.05, 3.08, 272, 273, 270, 149, 271/151, 274
See application file for complete search history.

(56) References Cited

U.S. PATENT DOCUMENTS

| | | | | |
|---|---|---|---|---|
| 3,683,758 | A | | 8/1972 | Feldkamper |
| 4,429,866 | A | | 2/1984 | Castro-Hahn |
| 4,579,446 | A | | 4/1986 | Fujino et al. |
| 4,580,774 | A | | 4/1986 | Yamaguchi et al. |
| 4,587,532 | A | | 5/1986 | Asano |
| 4,836,119 | A | | 6/1989 | Siraco et al. |
| 4,925,180 | A | | 5/1990 | Golicz |
| 5,004,222 | A | | 4/1991 | Dobashi |
| 5,008,713 | A | * | 4/1991 | Ozawa et al. ..... 399/402 |
| 5,072,921 | A | | 12/1991 | Golicz |
| 5,080,340 | A | | 1/1992 | Hacknauer et al. |
| 5,090,674 | A | * | 2/1992 | Ozawa ..... 271/3.03 |
| 5,095,342 | A | | 3/1992 | Farrell et al. |
| 5,110,104 | A | | 5/1992 | Wakao et al. |
| 5,147,092 | A | | 9/1992 | Driscoll et al. |
| 5,159,395 | A | | 10/1992 | Farrell et al. |
| 5,208,640 | A | | 5/1993 | Horie et al. |
| 5,272,511 | A | | 12/1993 | Conrad et al. |
| 5,326,093 | A | | 7/1994 | Sollitt |
| 5,342,038 | A | | 8/1994 | Suter |
| 5,435,544 | A | | 7/1995 | Mandel |
| 5,465,955 | A | | 11/1995 | Krupica et al. |
| 5,473,419 | A | | 12/1995 | Russel et al. |
| 5,489,969 | A | | 2/1996 | Soler et al. |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner* — Prasad Gokhale
(74) *Attorney, Agent, or Firm* — Fay Sharpe LLP

(57) ABSTRACT

The present disclosure provides a printing device comprising a sheet buffer including a paper path having a plurality of nip pairs for selectively receiving and releasing a plurality of printer sheets. The plurality of nip pairs include a fixed load nip pair, a fixed unload nip pair, and at least another intermediate fixed nip pair therebetween. In a first operation each subsequent sheet of the plurality of sheets is shingled over a previous sheet wherein the plurality of sheets can be stopped in the intermediate nip pair or pairs. Individual sheets of the plurality of sheets can be advanced to the unload nip pair sequentially in a second operation whereupon the individual sheets are successively unloaded as needed in a first in first out order.

5 Claims, 7 Drawing Sheets

U.S. PATENT DOCUMENTS 5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,743,661 A 4/1998 Tamura
5,778,377 A 7/1998 Marlin et al.
5,884,910 A 3/1999 Mandel
5,918,876 A * 7/1999 Maruyama et al. ..... 271/228
5,995,721 A 11/1999 Rourke et al.
6,059,284 A 5/2000 Wolf et al.
6,125,248 A 9/2000 Moser
6,241,242 B1 6/2001 Munro
6,297,886 B1 10/2001 Cornell
6,341,773 B1 1/2002 Aprato et al.
6,352,253 B1 3/2002 Hayakawa et al.
6,384,918 B1 5/2002 Hubble, III et al.
6,386,537 B1 * 5/2002 Howard et al. ..... 271/303
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,575,457 B2 6/2003 Bakoledis
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,644,657 B2 * 11/2003 Wright et al. ..... 271/242
6,687,569 B1 * 2/2004 Skinger et al. ..... 700/220
6,776,409 B2 8/2004 Cook
6,796,558 B1 9/2004 Dorer
6,819,906 B1 11/2004 Herrmann et al.
6,902,162 B2 6/2005 Otto et al.
6,925,283 B1 8/2005 Mandel et al.
6,959,165 B2 10/2005 Mandel et al.
6,973,286 B2 12/2005 Mandel et al.
7,024,152 B2 4/2006 Lofthus et al.
7,040,616 B2 * 5/2006 Stemmle ..... 271/270
7,192,025 B1 3/2007 Golicz et al.
7,628,396 B2 * 12/2009 Moore et al. ..... 271/197
7,731,188 B2 * 6/2010 deJong et al. ..... 271/273
7,740,241 B2 * 6/2010 Itoh et al. ..... 271/262
7,832,719 B2 * 11/2010 Van Den Berg ..... 271/3.03
7,918,443 B2 * 4/2011 Fokos ..... 270/52.19
7,959,146 B2 * 6/2011 Gerlier et al. ..... 271/3.03
8,020,865 B2 * 9/2011 Bober et al. ..... 271/272
2002/0078012 A1 6/2002 Ryan et al.
2002/0103559 A1 8/2002 Gartstein
2003/0077095 A1 4/2003 Conrow
2003/0151192 A1 8/2003 Otto
2003/0155706 A1 * 8/2003 Tsutoh ..... 271/272
2004/0046316 A1 * 3/2004 Tsuzawa ..... 271/264
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2006/0033771 A1 2/2006 Lofthus et al.
2006/0039728 A1 2/2006 deJong et al.
2006/0056953 A1 3/2006 Masotta et al.
2006/0066885 A1 3/2006 Anderson et al.
2006/0067756 A1 3/2006 Anderson et al.
2006/0067757 A1 3/2006 Anderson et al.
2006/0114313 A1 6/2006 Moore
2006/0114497 A1 6/2006 Anderson et al.
2006/0115284 A1 6/2006 Grace et al.
2006/0115287 A1 6/2006 Roof
2006/0115288 A1 6/2006 Roof
2006/0132815 A1 6/2006 Lofthus et al.
2006/0176336 A1 8/2006 Moore et al.
2006/0197966 A1 9/2006 Viturro et al.

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2002, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S Appl. No. 10/924,459, filed Aug. 23, 2004, Mandel et al.
U.S Appl. No. 10/933,556, filed Sep. 3, 2004, Spencer et al.
U.S Appl. No. 10/953,953, filed Sep. 29, 2004, Radulski et al.
U.S. Appl. No. 10/999,450, filed Nov. 30, 2004, Lofthus et al.
U.S. Appl. No. 11/000,168, Nov. 30, 2004, Biegelsen et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalai et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.

U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.
U.S. Appl. No. 11/417,411, filed May 4, 2006, DeGruchy.
U.S. Appl. No. 11/432,924, filed May 12, 2006, Lieberman et al.
U.S. Appl. No. 11/432,905, filed May 12, 2006, Mongeon et al.
U.S. Appl. No. 11/432,993, filed May 12, 2006, Anderson.
U.S. Appl. No. 11/487,206, filed Jul. 14, 2006, Wu et al.
U.S. Appl. No. 11/485,870, filed Jul. 13, 2006, Moore.
U.S. Appl. No. 11/474,247, filed Jun. 23, 2006, Moore.
U.S. Appl. No. 11/483,747, filed Jul. 6, 2006, Meetze.
U.S. Appl. No. 11/495,017, filed Jul. 28, 2006, Bean.
U.S. Appl. No. 11/501,654, filed Aug. 9, 2006, Mestha et al.

* cited by examiner

SHEET BUFFERING SYSTEM

This application is a divisional application of U.S. patent application Ser. No. 11/528,770 filed Sep. 27, 2006 now U.S. Pat. No. 7,766,327.

BACKGROUND

The present disclosure provides for an apparatus in conjunction with a plurality of image marking engines or image recording apparatuses providing a multifunctional and expandable printing system. It finds particular application in conjunction with integrated printing modules consisting of several marking engines, each having the same or different printing capabilities, and will be described with particular reference thereto. However, it is to be appreciated that the present exemplary embodiments are also amenable to other like applications.

Various apparatuses for recording images on sheets have heretofore been put into practical use. For example, there are copying apparatuses of the type in which the images of originals are recorded on sheets through a photosensitive medium or the like, and printers in which image information transformed into an electrical signal is reproduced as an image on a sheet by an impact system (the type system, the wire dot system or the like) or a non-impact system (the thermosensitive system, the ink jet system, the laser beam system or the like).

The marking engine of an electronic reprographic printing system is frequently an electrophotographic printing machine. In such a machine, a photoconductive belt is charged to a substantially uniform potential to sensitize the belt surface. The charged portion of the belt is thereafter selectively exposed. Exposure of the charged photoconductive belt or member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multilayered toner image on the copy sheet. Thereafter, the multilayered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images is transferred thereto and then to an output catch tray for subsequent removal. With regard to multi-color printing, as one example, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

The present disclosure is directed to the art of paper sheet handling and, more particularly, to a sheet buffering system. The disclosure is especially suited for use in the paper handling and transport systems of electrophotographic printing machines and will be described with reference thereto; however, as will become apparent, the disclosure could be used in many types of paper sheet handling systems in a variety of different machines.

In electrophotographic printing machines, it is sometimes necessary or desirable to temporarily hold or delay the transport of individual paper sheets at various times in the processor to provide additional time for downstream processing to be performed. Such temporary holding or delaying of sheets is generally referred to as "buffering" and has been accomplished in many different ways. One prior art method of buffering has been to temporarily slow or stop a roll nip or other paper transport for a period of time equal to the inter-copy-gap between successive sheets. Of course, this yields only a very short buffering time. If longer times are required, other systems must be used. For example, multiple path systems and systems which run sheets against stalled roll pairs or stop gates have sometimes been used.

In printing a job matrix requiring, for example, both monochrome and color mixed prints, the monochrome printer would be forced to reduce its productivity if several color prints were sequentially required in the job matrix. The color engine, if required to print on demand by matrix orientation may be forced to continually cycle up and down numerous times if the majority of the matrix was only monochrome with color inserts. Single print output is not very efficient and wastes supplies.

In multiple integrated print engine applications, different print engines can be combined for various output applications. For example, relatively fast monochrome engines combined with much slower color engines. This disclosure relates to a document handling system for printing systems in which a set of individual documents may be merged from multiple print engines into a single job matrix. This allows, for example, slower color print images to be printed sequentially in advance and delivered into the print job matrix when needed.

U.S. Pat. No. 5,383,656 to Mandel et. al. and U.S. Pat. No. 4,093,372 to Guenther are incorporated by reference as background information.

The following patents/applications, the disclosures of each being totally incorporated herein by reference are mentioned:

U.S. Publication No. US-2006-0114497-A1, Published Jun. 1, 2006, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

U.S. Publication No. US-2006-0067756-A1, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Publication No. US-2006-0067757-A1, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application No. US-2006-0012102-A1, published Jan. 19, 2006, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. Publication No. US-2006-0033771-A1, published Feb. 16, 2006, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.;

U.S. Publication No. US-2006-0039728-A1, published Feb. 23, 2006, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. Publication No. US-2006-0115284-A1, Published Jun. 1, 2006, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. Publication No. US-2006-0115287-A1, Published Jun. 1, 2006, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. Publication No. US-2006-0115288-A1, Published Jun. 1, 2006, entitled "GLOSSING SYSTEM FOR USE IN A TIPP ARCHITECTURE," by Bryan J. Roof;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. Publication No. US-2006-0176336-A1, Published Aug. 10, 2006, entitled "PRINTING SYSTEMS," by Steven R. Moore, et al.;

U.S. Publication No. US-2006-0132815-A1, Published Jun. 22, 2006, entitled "PRINTING SYSTEMS," by Robert M. Lofthus, et al.;

U.S. Publication No. US-2006-0197966-A1, Published Sep. 7, 2006, entitled "GRAY BALANCE FOR A PRINTING SYSTEM OF MULTIPLE MARKING ENGINES," by R. Enrique Viturro, et al.;

U.S. Publication No. US-2006-0114313-A1, Published Jun. 1, 2006, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al., U.S. application Ser. No. 11/109,996, filed Apr. 20, 2005, entitled "PRINTING SYSTEMS," by Michael C. Mongeon, et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. Publication No. US-2006-0066885-A1, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/156,778, filed Jun. 20, 2005, entitled "PRINTING PLATFORM," by Joseph A. Swift;

U.S. application Ser. No. 11/157,598, filed Jun. 21, 2005, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/189,371, filed Jul. 26, 2005, entitled "PRINTING SYSTEM," by Steven R. Moore, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM," by Eric Hamby, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS," by Goodman, et al.;

U.S. application Ser. No. 11/234,553, filed Sep. 23, 2005, entitled "MAXIMUM GAMUT STRATEGY FOR THE PRINTING SYSTEMS," by Michael C. Mongeon;

U.S. application Ser. No. 11/234,468, filed Sep. 23, 2005, entitled "PRINTING SYSTEM," by Eric Hamby, et al.;

U.S. application Ser. No. 11/247,778, filed Oct. 11, 2005, entitled "PRINTING SYSTEM WITH BALANCED CONSUMABLE USAGE," by Charles Radulski, et al.;

U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/274,638, filed Nov. 15, 2005, entitled "GAMUT SELECTION IN MULTI-ENGINE SYSTEMS," by Wencheng Wu, et al.;

U.S. application Ser. No. 11/287,177, filed Nov. 23, 2005, entitled "MEDIA PASS THROUGH MODE FOR MULTI-ENGINE SYSTEM," by Barry P. Mandel, et al.;

U.S. application Ser. No. 11/287,685, filed Nov. 28, 2005, entitled "MULTIPLE IOT PHOTORECEPTOR BELT SEAM SYNCHRONIZATION," by Kevin M. Carolan;

U.S. application Ser. No. 11/291,860, filed Nov. 30, 2005, entitled "MEDIA PATH CROSSOVER CLEARANCE FOR PRINTING SYSTEM," by Keith L. Willis;

U.S. application Ser. No. 11/292,388, filed Nov. 30, 2005, entitled "PRINTING SYSTEM," by David A. Mueller;

U.S. application Ser. No. 11/292,163, filed Nov. 30, 2005, entitled "RADIAL MERGE MODULE FOR PRINTING SYSTEM," by Barry P. Mandel, et al.;

U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/314,828, filed Dec. 21, 2005, entitled "MEDIA PATH DIAGNOSTICS WITH HYPER MODULE ELEMENTS," by David G. Anderson, et al;

U.S. application Ser. No. 11/314,774, filed Dec. 21, 2005, entitled "METHOD AND APPARATUS FOR MULTIPLE PRINTER CALIBRATION USING COMPROMISE AIM," by R. Victor Klassen;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/317,167, filed Dec. 23, 2005, entitled "PRINTING SYSTEM," by Robert M. Lofthus, et al.;

U.S. application Ser. No. 11/331,627, filed Jan. 13, 2006, entitled "PRINTING SYSTEM INVERTER APPARATUS", by Steven R. Moore;

U.S. application Ser. No. 11/341,733, filed Jan. 27, 2006, entitled "PRINTING SYSTEM AND BOTTLENECK OBVIATION", by Kristine A. German;

U.S. application Ser. No. 11/349,828, filed Feb. 8, 2005, entitled "MULTI-DEVELOPMENT SYSTEM PRINT ENGINE", by Martin E. Banton;

U.S. application Ser. No. 11/359,065, filed Feb. 22, 2005, entitled "MULTI-MARKING ENGINE PRINTING PLATFORM", by Martin E. Banton;

U.S. application Ser. No. 11/363,378, filed Feb. 27, 2006, entitled "SYSTEM FOR MASKING PRINT DEFECTS", by Anderson, et al.;

U.S. application Ser. No. 11/364,685, filed Feb. 28, 2006, entitled "SYSTEM AND METHOD FOR MANUFACTURING SYSTEM DESIGN AND SHOP SCHEDULING USING NETWORK FLOW MODELING", by Hindi, et al.;

U.S. application Ser. No. 11/378,046, filed Mar. 17, 2006, entitled "PAGE SCHEDULING FOR PRINTING ARCHITECTURES", by Charles D. Rizzolo, et al.;

U.S. application Ser. No. 11/378,040, filed Mar. 17, 2006, entitled "FAULT ISOLATION OF VISIBLE DEFECTS WITH MANUAL MODULE SHUTDOWN OPTIONS", by Kristine A. German, et al.;

U.S. application Ser. No. 11/399,100, filed Apr. 6, 2006, entitled "SYSTEMS AND METHODS TO MEASURE BANDING PRINT DEFECTS", by Peter Paul;

U.S. application Ser. No. 11/403,785, filed Apr. 13, 2006, entitled "MARKING ENGINE SELECTION", by Martin E. Banton et al.;

U.S. application Ser. No. 11/417,411, filed May 4, 2006, entitled "DIVERTER ASSEMBLY, PRINTING SYSTEM AND METHOD", by Paul J. Degruchy;

U.S. application Ser. No. 11/432,993, filed May 12, 2006, entitled "TONER SUPPLY ARRANGEMENT", by David G. Anderson;

U.S. application Ser. No. 11/432,924, filed May 12, 2006, entitled "AUTOMATIC IMAGE QUALITY CONTROL OF MARKING PROCESSES", by David J. Lieberman;

U.S. application Ser. No. 11/432,905, filed May 12, 2006, entitled "PROCESS CONTROLS METHODS AND APPARATUSES FOR IMPROVED IMAGE CONSISTENCY", by Michael C. Mongeon et al.;

U.S. application Ser. No. 11/474,247, filed Jun. 23, 2006, entitled "CONTINUOUS FEED PRINTING SYSTEM", by Steven R. Moore;

U.S. application Ser. No. 11/483,747, filed Jul. 6, 2006, entitled "POWER REGULATOR OF MULTIPLE MARKING ENGINES", by Murray O. Meetze, Jr.;

U.S. application Ser. No. 11/485,870, filed Jul. 13, 2006, entitled "PARALLEL PRINTING SYSTEM", by Steven R. Moore;

U.S. application Ser. No. 11/487,206, filed Jul. 14, 2006, entitled "BANDING AND STREAK DETECTION USING CUSTOMER DOCUMENTS", by Wencheng Wu, et al.;

U.S. application Ser. No. 11/495,017, filed Jul. 28, 2006, entitled "SYSTEM AND METHOD FOR PARTIAL JOB INTERRUPT OF NORMAL ORDER OF JOB QUEUE OF MARKING SYSTEMS", by Lloyd F. Bean, II;

U.S. application Ser. No. 11/501,654, filed Aug. 9, 2006, entitled "METHOD FOR SPATIAL COLOR CALIBRATION USING HYBRID SENSING SYSTEMS", by Lalit Keshav Mestha et al.

U.S. application Ser. No. 11/522,171, filed Sep. 15, 2006, entitled "FAULT MANAGEMENT FOR A PRINTING SYSTEM", by Meera Sampath, et al.

BRIEF DESCRIPTION

The present disclosure provides a printing device comprising a sheet buffer including a paper path having a plurality of nip pairs for selectively receiving and releasing a plurality of printer sheets. The plurality of nip pairs include a fixed load nip pair, a fixed unload nip pair, and at least another intermediate fixed nip pair therebetween. In a first operation each subsequent sheet of the plurality of sheets is shingled over a previous sheet wherein the plurality of sheets can be stopped in the intermediate nip pair or pairs. Individual sheets of the plurality of sheets can be advanced to the unload nip pair sequentially in a second operation whereupon the individual sheets are successively unloaded as needed in a first in first out order.

The present disclosure further provides for a printing device comprising a sheet buffer including a paper path having a plurality of nip pairs for selectively receiving and releasing a plurality of printer sheets. The plurality of nip pairs can include a load nip pair, a release nip pair, and at least a first translating nip pair therebetween capable of handling a plurality of sheet sizes. In a first position each subsequent sheet of the plurality of sheets can be shingled over a previous sheet wherein the plurality of sheets can be stopped in the translating nip pair. The plurality of shingled sheets can be translated together by the translating nip pair moving a distance from the first position to a second position wherein a lead edge of a first or bottommost printer sheet is positioned for engagement with the release nip pair.

The present disclosure still further provides for a printing device comprising a sheet buffer including a paper path having a plurality of nip pairs for selectively receiving and releasing a plurality of printer sheets. The plurality of nip pairs include a fixed load nip pair, a fixed center nip pair, and a fixed unload nip pair. The plurality of nip pairs further include at least a first and a second releasable nip pair, the first nip pair between the load nip pair and the center nip pair and the second nip pair between the unload nip pair and the center nip pair. Each subsequent sheet of the plurality of sheets is shingled over a previous sheet wherein the first and second releasable nip pairs can be selectively releasable for loading and unloading different size printer sheets in a first in first out order in the sheet buffer.

And still further, the present disclosure provides for a printing device comprising a sheet buffer including a paper path having a plurality of nips for selectively receiving and releasing a plurality of printer sheets. The plurality of nips including a load group of nips and an unload group of nips. The load group including at least two nip pairs and the unload group including at least two nip pairs. Within each of the groups, an intermediate nip pair selectively translates from a first position to a second position with respect to the other nip pairs to accommodate various sheet lengths. One of the nip pairs of each group can include at least one fixed nip pair. Within each groups at least the intermediate nip pair is selectively releasable wherein each subsequent sheet entering the sheet buffer shingles over a previously entered and within each group the intermediate nip pair selectively opens and closes to insert, hold, and release the sheets.

Further still, the present disclosure provides a printing device comprising a sheet buffer including a paper path having a plurality of nip pairs for selectively receiving and releasing a plurality of printer sheets. The plurality of nip pairs include a fixed load nip pair, a fixed unload nip pair, and at least another intermediate fixed nip pair therebetween. In a first operation each subsequent sheet of the plurality of sheets can be overlapped over a previous sheet wherein the plurality of sheets can be stopped between a span defined by the load nip pair and a next succeeding nip pair. The individual sheets of the plurality of sheets are advanced to the unload nip pair sequentially in a second operation whereupon said individual sheets are successively unloaded as needed.

DETAILED DESCRIPTION

Figure 1:
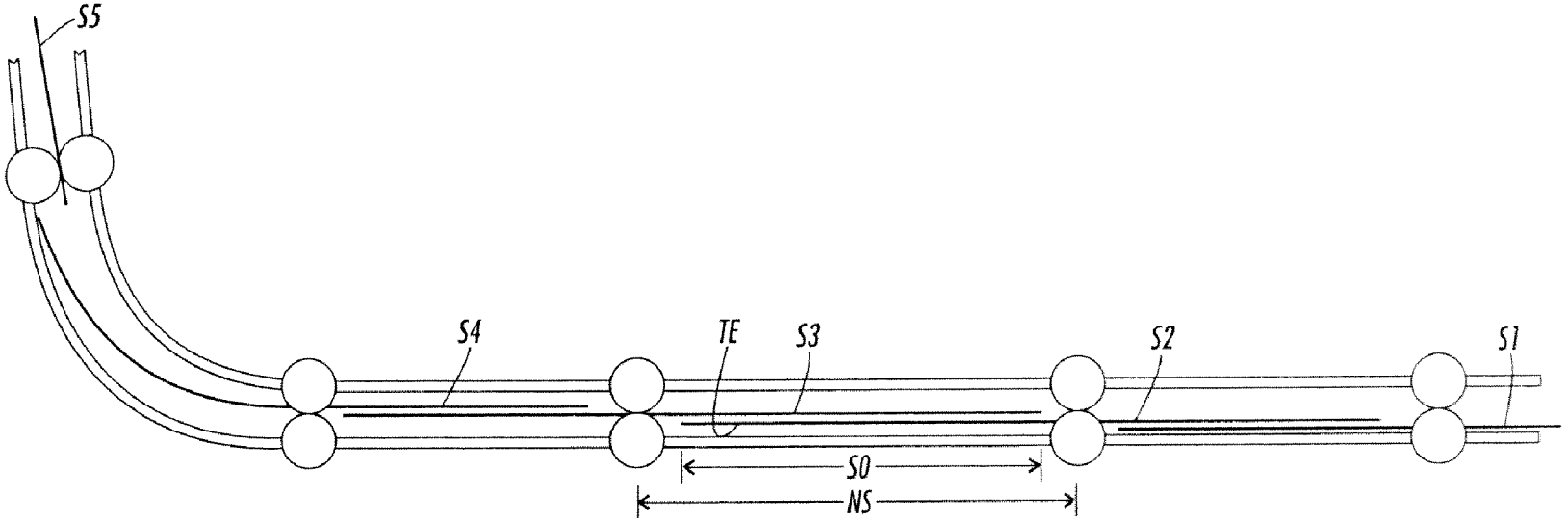
FIG. 1 is a schematic elevational view of a portion of a paper transport system according to a first embodiment.

The sheet buffer transports, to be described below, can be combined with a plurality of Image Marking Engines (IME). The IMEs can be, for example, any type of ink-jet printer, an electrophotographic printer, a thermal head printer that is used in conjunction with heat sensitive paper, or any other apparatus used to mark an image on a substrate. The IM Es can be, for example, black only (monochrome) and/or color printers. Any number of varieties, types, alternatives, quantities, and combinations of IMEs can be used within the scope of the exemplary embodiments. It is to be appreciated that, each of the IMEs can include an input/output interface, a memory, a marking cartridge platform, a marking driver, a function switch, a controller and a self-diagnostic unit, all of which can be interconnected by a data/control bus. Each of the IMEs can have a different processing speed capability.

Each marking engine can be connected to a data source over a signal line or link. The data source provides data to be output by marking a receiving medium. In general, the data source can be any of a number of different sources, such as a scanner, a digital copier, a facsimile device that is suitable for generating electronic image data, or a device suitable for storing and/or transmitting the electronic image data, such as a client or server of a network, or the interne, and especially the worldwide web. The data source may also be a data carrier such as a magnetic storage disk, CD ROM, or the like, that contains data to be output by marking. Thus, the data source can be any known or later developed source that is capable of providing scanned and/or synthetic data to each of the marking engines.

The link can be any known or later developed device or system for connecting the image data source to the marking engine, including a direct cable connection, a public switched telephone network, a wireless transmission channel, a connection over a wide area network or a local area network, a connection over an intranet, a connection over the internet, or a connection over any other distributed processing network or system. In general, the link can be any known or later developed connection system or structure usable to connect the data source to the marking engine. Further, it should be appreciated that the data source may be connected to the marking engine directly.

In integrated printing architectures comprising multiple marking engines, there is a need for extremely reliable sheet buffers to remove printer sheet exit time variations and synchronize the printer exit velocity with the highway timing and velocity, and buffer sheets in architectures with mixed printers, e.g. black/white and color printers to achieve efficient printer utilization and maximum system throughput. It is possible to achieve the goals described above with relatively small buffers, i.e. a buffer capacity of several sheets is enough. The present disclosure provides a buffer that is extremely reliable by using only standard paper path components, for example, nips, nip releases and baffles.

The present disclosure provides a method and apparatus for buffering sheets at the output of a printer engine by overlapping or shingling sheets within an output path prior to delivery to a sheet transport highway. This allows the print engine to print in advance, store, and then deliver the sheets on demand into the job matrix. The buffering concept can utilize a standard type paper path transport assembly without the need of nip release or friction devices to separate the sheets.

Figure 2:
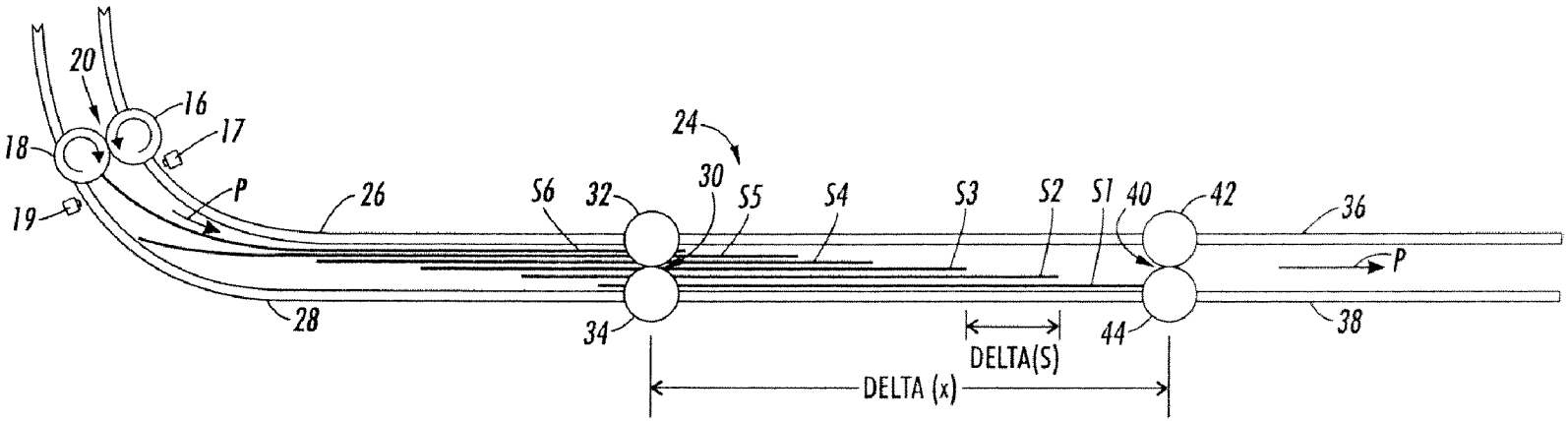
FIG. 2 is another variation of a portion of a paper transport system according to the first embodiment.

The four basic operations of the buffer can be summarized as follows: insert overlapping sheets into buffer stack, hold stack, exit sheet from buffer stack, and advance stack. As an example, FIGS. 1 and 2 show the operation of a multiple sheet buffer. For a larger sheet length buffer, the left and right groups of nips can be expanded with adjacent nips spaced a distance of delta(x) apart.

Referring now to FIG. 1, the buffer apparatus provides for physically controlling the previous sheet's trail edge for initial overlap loading and independent drives on the nips following the load point. Drive nips through the middle of the overlapping buffer can be drive coupled, however the load sequence may be altered to release a sheet unless the buffer was already filled to capacity. Overlap loading can be done on a straight paper path, although it is to be appreciated that a hump feature, bail, or vacuum can be incorporated to control a preceding trail edge of a sheet. The amount of sheet overlap SO, for one implementation, can be defined by an amount less than the nip spacing NS to allow for sheet decoupling at the load and release points. Overlapped sheets S1, S2, S3, and S4 can be stopped in transport, with a previous trail edge TE of for example, S4 held below the nip entrance while a next sheet S5 is driven forward into the buffer creating overlap. Subsequently, all of the sheets advance forward to load and accept the next sheet. The first sheet S1 in the buffer can be ready for release at any time. The sheets can be simultaneously loaded and released at any time up to buffer capacity without any nip release mechanism. Longer sheets can be coupled to multiple nips within the buffer series, but can remain uncoupled for load and release. The aforementioned results in approximately two times the storage capacity over linear cascaded storage for 8.5×11 inch size paper across the buffered length. It is to be appreciated that the aforementioned buffering concept provides simplicity and reliability at a very low cost. The described buffer method and apparatus can also be extended to finisher applications. The paper path transport can be curved (not shown) to allow for sheet overlap creation at any nip location and allow the buffer to be either front or rear loaded for greater flexibility.

In yet a further embodiment, the present disclosure proposes a method and apparatus for buffering sheets at the output of a printer engine by overlapping sheets within its output path prior to delivery to a sheet transport highway. This allows the print engine to print in advance, store, and then deliver the sheets on demand into the job matrix. The buffering concept utilizes a sheet loading nip zone whereby the previous sheet's trail edge can be controlled for initial overlap loading allowing the next or subsequent sheet to be fed over the top of the previous one. A buffering center or intermediate nip can incrementally collect a plurality of sheets as they are received in a controlled shingled orientation. The sheet buffer can then hold and control the stack while operating in conjunction with an unloading nip to individually separate and release the shingled sheet stack as the sheets are required into the job matrix. The buffer can utilize standard transport nip components without the need for nip release or friction devices to separate the sheets. The amount of sheet overlap can be maximized (regardless of paper length) while limiting the minimum shingle offset needed to independently transfer control of the incoming or outgoing sheet between nips. The shingle device can offer up to approximately 10× the storage capacity for large sheets over linear cascading of sheets across the transport length. The buffering method offers large buffering capacity limited by the minimum required shingle length divided into the sheets length with minimal complexity. The loading nip can be closely coupled to part of the print engine since it can run continuously at constant velocity.

In the drawings, like reference numerals have been used throughout to designate identical elements. FIG. 2 schematically depicts a portion of a sheet transport system having a sheet buffering arrangement according to the disclosure incorporated therein. The system shown in FIG. 2 is intended for use in an electrophotographic printing machine; however, the apparatus and system could clearly be used in a variety of other types of equipment incorporating sheet handling and transportation systems. Broadly, as illustrated in FIG. 2, the apparatus generally comprises guide means which define a predetermined course of paper movement or path indicated generally by the line P. The guide means comprise a spaced pairs of respective upper and lower guide panels (not shown), respectively, which direct sheets to a first pair of horizontally positioned driven rolls 16 and 18, respectively. The rolls 16 and 18 are positioned on each side of path P and driven in the direction of the arrows to define a first drive nip 20.

The buffering station 24 is located immediately downstream of the drive rolls 16, 18 and includes upper and lower sheet guides 26 and 28 which are positioned in spaced opposed relationship and arranged to direct sheets coming from the drive nip 20 downwardly into the nip 30 of a second pair of spaced rolls 32 and 34, respectively.

Sheets passing through the nip 30 are received and directed along the predetermined path of paper movement to subsequent use or processing equipment (not shown) by suitable guide means in the form of guide plates or panels 36 and 38.

The rolls 32 and 34 can be a standard driver and idler nip pair or each can be provided with drive means capable of uniform operation for improved buffer stack control. The drive means can comprise any standard type of drive motor. Although not illustrated, roll 34 can be provided with a first independent drive means. Roll 32 can be a simple idler or can be driven in a similar manner from another independent or ganged drive means. The drive means can be controlled from a main controller unit. Suitable sheet sensors 17 and 19 can be positioned just downstream of the rolls 16 and 18 to detect the lead edge and trail edge of sheets entering the buffering station 24.

The system and apparatus shown in FIG. 2 allows one or more sheets to be stopped in the buffering station 24 and held in nip 30 and then incrementally transferred downstream into a nip 40 of a third pair of spaced rolls 42, 44. While this function is being carried out, the system maintains a positive drive on the sheets at all times. The system can be configured so that the driven rolls of 32 and/or 34 have a sufficient coefficient of friction relative to the paper being handled. Multiple sheet interfaces are controlled by applying sufficient normal force within nip 30 and relying on sheet to sheet coefficient of friction to advance the plurality of sheets in unison.

In operation a first buffered sheet can be driven into the buffering nip 30 by being directed thereto from rolls 16 and 18. At the time the sheet can be directed into the buffering nip 30 which is being driven from its respective drive means. As the trailing edge of the sheet passes the sensors 17, 19, the controller acts to stop the driving movement of nip 30.

It should be noted as shown in FIG. 2 (and illustrated in FIG. 3) that when the sheet has moved to the stopped position, the trailing edge can be in a position slightly behind roll 18. This places the first sheet's trail edge in a position such that the second sheet to enter the buffering station 24 from rolls 16, 18 will enter at a position above the first stopped sheet and advance forward into the buffer station 24 creating overlap with the previous sheet. As the second sheet approaches nip 30, the nip 30 drive means is once again engaged to advance the first sheet along with the second sheet until the trail edge of the second sheet is seen at sensors 17 and 19. Drive nip 30 is then stopped again and the buffer is ready to receive the next consecutive or subsequent sheet. The aforementioned is shown in FIG. 2 wherein the consecutive sheets entering the buffer are engaged between the first sheet S1 and roller 32 in an incremental shingled orientation. With the desired sheets loaded into the buffered stack of nip 30, nip 30 can be incrementally actuated on demand to drive sheets S1, S2, and all other remaining sheets out of the stack and into nip 40 to exit the buffering station 24 in first in first out sequential order. It is to be appreciated that nip 30 can be stopped for any predetermined period of time to hold buffered sheets within the buffer 24 for delivery as required.

It is to be appreciated that the single set of drive rolls in combination with superposed idler rolls can hold a first sheet while a second, third, fourth, fifth, sixth, etc. sheet is driven into the nip between the driven and idler rolls. More particularly, as illustrated, the set of opposed rolls 16 and 18, defining a feed nip 20, can be driven in the direction shown to feed paper sheets S1-S6 along the paper path 58 to the buffering station 24.

The buffering station 24 can include support and guide baffles to confine the sheets moving along the paper path and direct them into the roll arrangement 42, 44. The roll arrangement 42, 44 comprise rolls that are driven from a suitable drive.

In operation, the first sheet S1 to enter the buffering station 24 is stopped at the location shown by sheet S6, by stopping the drive nip 30. These rolls can have a high coefficient of friction. The first sheet S1 is thus held in the position while the next sheet S2 enters the buffering station.

When the second sheet S2 is appropriately shingled with sheet S1, the controller actuates the drive rolls of nip 30. Both sheets S1 and S2 are then advanced through the nip since sheet S2 is loaded against sheet S1 by the roll 32. This generates a positive drive force on both sheets.

It is to be appreciated that the paper handling system provides for a set of individual documents to be maintained partially separated, but partially overlapping, during their buffering. The disclosure provides for the use of paper path elements, for example, nips, nip releases and baffles. Sheets can be buffered by storing them shingled relative to each other by a distance delta(s) apart in the process direction. Groups of nips, both comprising several nips, can be located at the entry of the buffering zone (i.e. entrance nip groups) and at the exit of the buffering zone (i.e. exit nip groups). The nips between each group can be spaced a distance of delta(x) apart. The operation of nips in each group can be coordinated to perform the "insert sheets into buffer", "hold sheets" and "feed out sheets from buffer" operations. The sheets can be stored shingled in the buffer by the buffering nip group positioned in between the entrance and exit nip groups. The insertion and feed out operations can be performed on each sheet independently from the other sheets. Appropriate point sensors at the buffer entrance and exit, together with feedback control of sheets and nips ensure the proper position control of all sheets entering and exiting the buffer, as well as the sheets inside the buffer.

Figure 3:
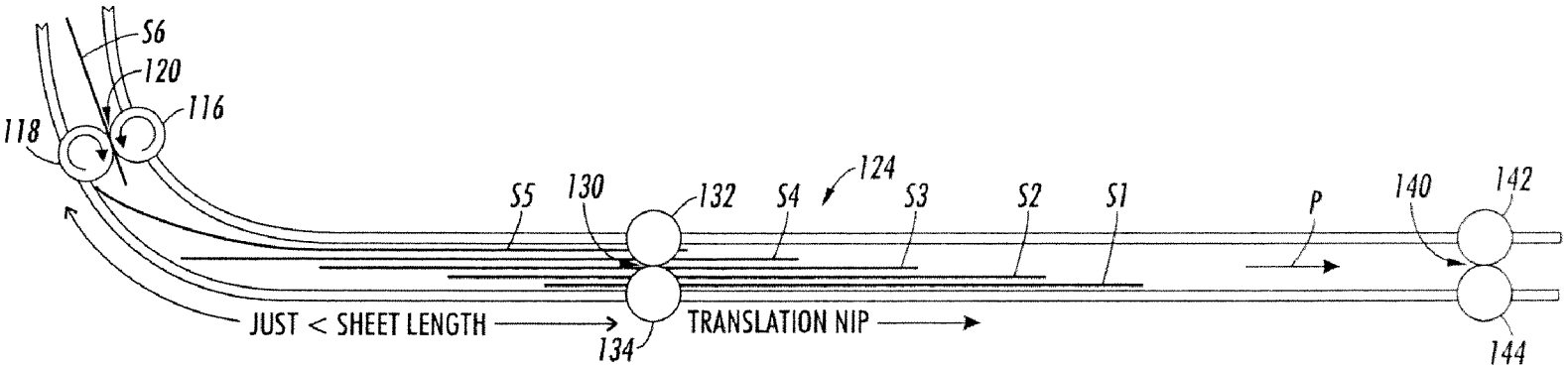
FIGS. 3-5 are schematic elevational views of a portion of a paper transport system showing a possible sequence of nip positions according to a second embodiment.
Figure 4:
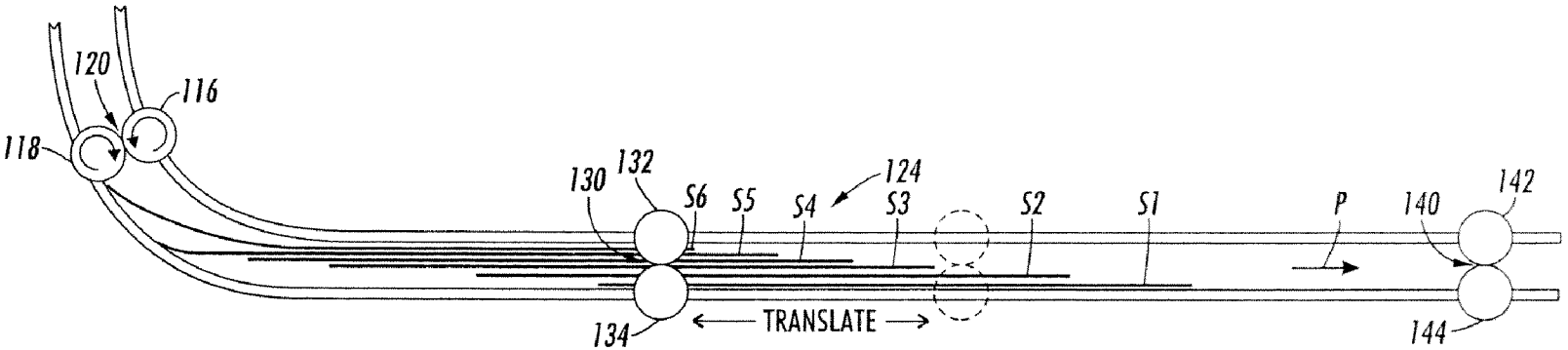
Figure 5:
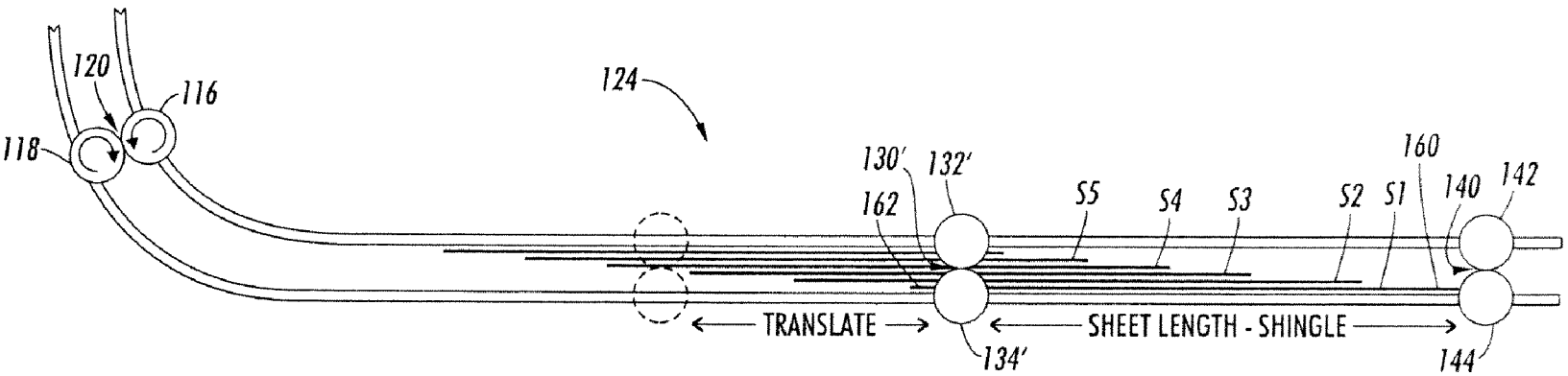

Referring now to FIGS. 3-5, another buffer 124 is therein shown which can hold sheets of the same size at any given time, but can switch sizes if emptied out first. The buffer 124 can consist of three groups of nips, one at the entrance 116, 118, one at the exit of the buffer 142, 144, and one therebetween 132, 134. Each group includes a nip 120, 130, 140, a variable distance apart. To be described in more detail below, the nip 130 is capable of translating. Sheets are held shingled in the buffer by nip 130 positioned between nips 120 and 140.

Referring again to FIGS. 3-5, the entrance or loading nip pair 116, 118, the translating or intermediate nip pair 132, 134, and the exit or release nip pair 142, 144 are therein shown. It is to be appreciated that the distance between the loading nip pair 116, 118 and the translating nip pair 132, 134, when the translating nip pair 132, 134 is in the load position (FIG. 3), is slightly less than the sheet length. The translating nip pair 132, 134 can translate from a first position to a second position. The second position for the translating nip pair is referenced 132', 134'.

Once the shingled sheets are loaded, the translation nip 130 holds the shingled sheets and translates them forward (FIG. 4) such that the leading edge 160 of a first or bottom sheet S1 is ready to engage with the release nip 140 (FIG. 5). As the buffered sheets S1, S2, S3, S4, S5 are needed or desired for the job set, the translating and release nips 130, 140 drive the shingled stack forward until the trail edge 162 of the first sheet S1 is released and under the control of the release or unload nip 140.

The translation of the 'center' nip pair 132, 134 is implemented for the purpose of buffering with multiple sheet lengths. It is to be appreciated that for a single sheet length the 'center' nip pair 132, 134 can be fixed and spaced appropriately from the load 116, 118 and release 142, 144 nip pairs as illustrated in FIG. 2.

Figure 6:
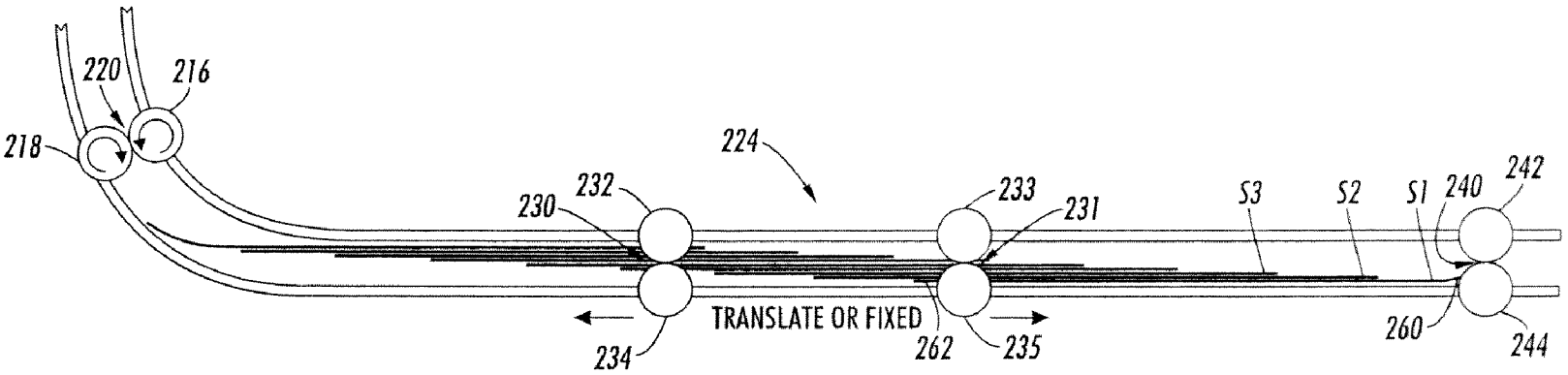
FIG. 6 is a schematic elevational view of a portion of a paper transport system according to a third embodiment; and, FIG. 7 is a schematic elevational view of a portion of a paper transport system according to a fourth embodiment.

Sheet buffer capacity can be increased by ganging additional nips 230, 231 (refer to FIG. 6) within the translation or fixed assembly of a buffer 224 on a common drive. This increases the existing capacity by substantially the total nip span divided by the minimum shingle distance without any need for nip releases. Also, the holding grip on the shingled stack at nips 230, 231 is increased for better position control. The entrance or loading nip pair 216, 218, the translating or intermediate nips 230, 231, and the exit or release nip pair 242, 244 are shown in FIG. 6. It is to be appreciated that the distance between the loading nip pair 216, 218 and the adjacent fixed or translating nip pair 232, 234, when the fixed or translating nip pair 232, 234 is in the load position, is slightly less than the sheet length. The translating nip pairs 232, 234 and 233, 235 can translate from a first position to a second position. The second position for the translating nip pairs is not illustrated. Once the shingled sheets are loaded, the translation nips 230, 231 hold the shingled sheets and translate them forward such that a leading edge 260 of a first or bottom sheet S1 is ready for engagement with the release nip 240. As the buffered sheets S1, S2, S3, S4, S5 are needed or desired for the job set, the translating and release nips 230, 231, 240 drive the shingled stack forward until the trail edge 262 of the first sheet S1 is released and under the control of the release or unload nip 240. Buffering of different media sheet sizes can be accommodated by positioning the entrance and exit nips accurately with respect to the intermediate center nips. The entrance nips, intermediate nips, and/or exit nips can be moveable and incorporate additional spanner nips in order for the buffer to accommodate media of different sizes.

Preventing stubbing at the buffer entrance is desirable. Sheets with up-curl or down-curl can present a problem as they enter the buffer. The LE of the entering sheet may stub on the TE of sheets already in the buffer. To minimize this risk, a slight curve that pushes down the TE of the sheets already in the buffer can be designed into the baffles. Also, the nips in the entrance nip group can be tilted to help guide the entering LE over the trail edge of the previous buffered stack.

In yet a further embodiment, the present disclosure proposes a method and apparatus for buffering sheets at the output of a printer engine by overlapping sheets within its output path prior to delivery to a sheet transport highway. This allows the print engine to print in advance, store, and then deliver the sheets on demand into the job matrix. The buffering concept can utilize a sheet-loading nip zone whereby the previous sheet's trail edge can be controlled for initial overlap shingle loading allowing the next sheet to be fed over the top of the previous one. A fixed buffer center nip with additional intermediate nip pairs located on each side of that center nip can be arranged. These intermediate nip pairs can be positioned and oriented for various sheet length requirements and equipped with nip release mechanisms. The closed or acting nip pairs along with the center nip incrementally collect a plurality of sheets as they are received in a controlled shingled orientation. They hold and control the stack and then operate in conjunction with an unloading nip to separate and individually release the shingled sheets, as they are required into the job matrix. The buffer can utilize standard transport nip components without the need for friction devices to separate the sheets. The amount of sheet overlap is maximized (regardless of paper length) and limited only to the minimum shingle offset needed to independently transfer control of the incoming or outgoing sheet between nips. The shingle device can offer up to approximately 10× the storage capacity over linear cascading of sheets across the transport length. The buffering method offers large buffering capacity limited by the minimum required shingle length divided into the sheet length plus the total span of acting intermediate nips. The loading nip can be closely coupled or part of the print engine since it can run continuously at constant velocity.

Figure 7:
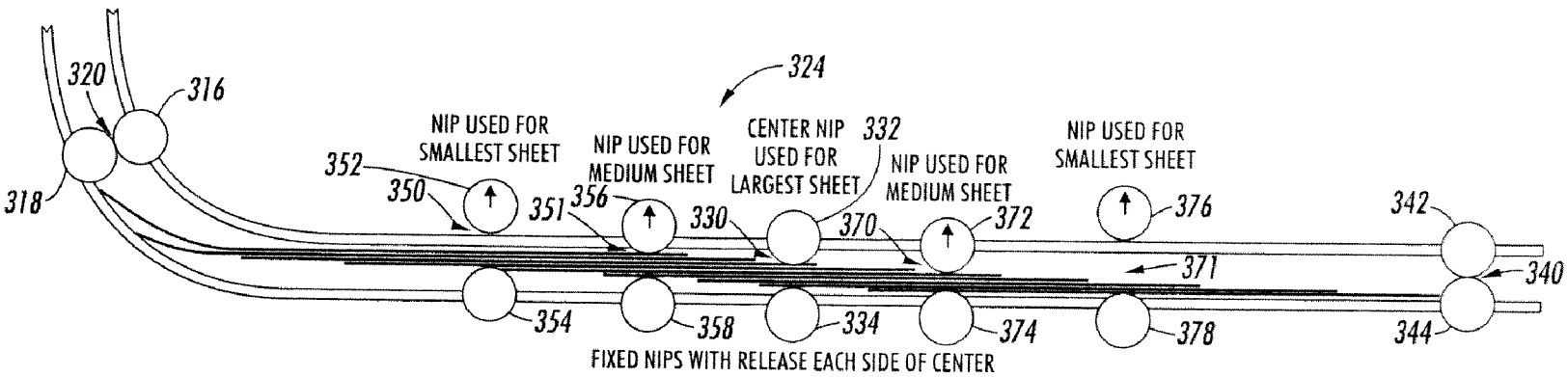

Referring now to FIG. 7, multiple sheet lengths can be buffered by replacing translating nips with multiple nip pairs 352, 354; 356, 358; 332, 334; 372, 374; 376, 378 positioned and oriented for various length requirements between the load 316, 318, center 332,334 and unload 342, 344 nip pairs. The multiple nips 350, 351, 370, 371 can include nip release mechanisms for selective opening of one or more nip pairs (FIG. 7). For small size sheets nips 350, 351, 370, 371 would remain closed. For medium size sheets nips 350, 371 would open while nips 351, 370 would remain closed. For large size sheets nips 350, 351, 370, 371 would remain open. Additional nip pairs can be added or the nips can be translated as needed for expanded sheet size requirements.

And still further, the present embodiment provides for a printing device comprising a sheet buffer including a paper path buffer having a plurality of nips for selectively receiving and releasing a plurality of printer sheets. Referring again to FIG. 7 with the omission of the center nip, the plurality of nips including a load group of nips 320,350,351 and unload group of nips 370, 371, 340. The load group including at least two nip pairs and the unload group including at least two nip pairs. Within each of the groups, the intermediate nip pairs 350, 351, 370, 371 can remain fixed or translate from a first position to a second position with respect to the other nip pairs 320, 340 to accommodate various sheet lengths. The rightmost and leftmost nip pairs of each group can include at least one fixed nip pair. The intermediate group of nips are releasable wherein after a first plurality of sheets entering the sheet buffer are shingled over the previous sheets, the nip pairs can open and close to perform an insert, hold and release function on the shingled stack.

It is to be appreciated that any of the described buffers can be coupled serially or in parallel to increase the buffering capacity. And any of the described buffers can be coupled to a parallel path for bypass or leapfrogging of a sheet ahead of another. The described method and embodiments can also be extended to finisher or other applications.

While the present printing apparatus and method has heretofore been described in connection with exemplary embodiments, it will be understood that it is not intended to limit the embodiments. On the contrary, it is intended to cover all alternatives, modifications and equivalents as may be included within the spirit and scope of the embodiments as defined by the appended claims.

The invention claimed is:

1. A printing device comprising:

a sheet buffer including a paper path having a plurality of nip pairs for selectively receiving and releasing a plurality of printer sheets;

said plurality of nip pairs including a fixed load nip pair, a fixed center nip pair, and a fixed unload nip pair;

said plurality of nip pairs further including at least a first and a second releasable nip pair, said first nip pair between said load nip pair and said center nip pair and said second nip pair between said unload nip pair and said center nip pair;

a controller for controlling the device such that each subsequent sheet of said plurality of sheets is shingled over a previous sheet wherein said first and second nip pairs selectively releasable for loading and unloading a first size printer sheet in a first in first out order in said sheet buffer;

said plurality of nips further including at least a third and a fourth releasable nip pair, said third nip pair between said load nip pair and said first nip pair and said fourth nip pair between said unload nip pair and said second nip pair wherein each subsequent sheet of said plurality of sheets is shingled over a previous sheet wherein said third and fourth nip pairs selectively releasable for loading and unloading a second size printer sheet in a first in first out order within a buffering zone; and, said first nip pair, said second nip pair, said third nip pair, and said fourth nip pair selectively releasable for loading and unloading a third size printer sheet in a first in first out order within said buffering zone.

2. The printing device of claim 1, wherein said first size printer sheet is larger than said second size printer sheet.

3. The printing device of claim 1, wherein a number of nip pairs between said load nip pair and said unload nip pair is equivalent to said plurality of sheet size requirements in said buffering zone.

4. The printing system of claim 1, wherein each sheet includes a selectable length; and, a spacing is defined between said load nip pair and said unload nip pair wherein said spacing is less than two times the maximum sheet length.

5. The printing device of claim 1, wherein a first subset of said sheets are held between said first nip pair, a second subset of sheets are held between said second nip pair, and a third subset of said sheets are held between yet another nip pair.

* * * * *